United States Patent [19]

Sommars

[11] 4,295,521

[45] Oct. 20, 1981

[54] HEAT EXCHANGER CORE MOUNTING APPARATUS

[75] Inventor: Mark F. Sommars, Sparland, Ill.

[73] Assignee: Caterpillar Tractor Co., Peoria, Ill.

[21] Appl. No.: 178,278

[22] Filed: Aug. 15, 1980

Related U.S. Application Data

[63] Continuation of Ser. No. 99,143, Sep. 27, 1979, abandoned.

[51] Int. Cl.[3] ..... F28F 9/26

[52] U.S. Cl. ..... 165/69; 165/144; 165/175

[58] Field of Search ..... 165/69, 76, 82, 144, 165/148, 149, 173, 175, 178; 285/137 R, 158, 162, 192

[56] References Cited

U.S. PATENT DOCUMENTS

| | | | |
|---|---|---|---|
| 2,260,638 | 10/1941 | Pfost | 165/144 |
| 3,391,732 | 7/1968 | Murray | 165/76 |
| 3,583,478 | 6/1971 | Fieni | 165/69 |
| 3,792,729 | 2/1974 | Perry | 165/175 |
| 3,835,923 | 9/1974 | Platell | 165/175 |
| 4,076,072 | 2/1978 | Bentz | 165/148 X |
| 4,081,879 | 4/1978 | Rubright | 16/2 |
| 4,164,255 | 8/1979 | Binet et al. | 165/76 |
| 4,191,244 | 3/1980 | Keske | 165/69 |
| 4,236,577 | 12/1980 | Neudeck | 165/175 |

FOREIGN PATENT DOCUMENTS

| | | | |
|---|---|---|---|
| 191441 | 8/1957 | Austria | 165/82 |
| 1129585 | 1/1957 | France | 165/173 |
| 205278 | 10/1923 | United Kingdom | 165/76 |
| 431863 | 7/1935 | United Kingdom | 165/76 |
| 1220249 | 1/1971 | United Kingdom | 165/69 |

*Primary Examiner*—Sheldon J. Richter
*Attorney, Agent, or Firm*—John W. Grant

[57] ABSTRACT

A heat exchanger core (16) is angularly mounted in portions (12,12*a*) of a supporting frame. Locaters (32,34) are provided to properly locate the core (16) on the frame (12,12*a*) relative to air flow across the core (16). A resilient sealing mount (54,56), seals the frame (12,12*a*) core (16) connection, accommodates the locators (32,34) and damps vibration between the frame (12,12*a*) and core (16).

7 Claims, 6 Drawing Figures

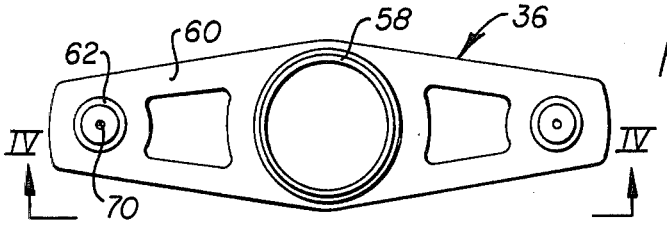
FIG.3.
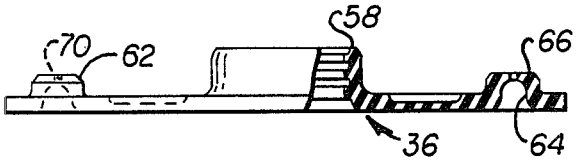
FIG.4.
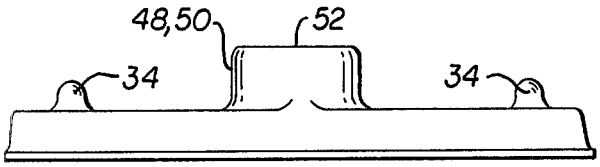
FIG.5.
FIG.6.
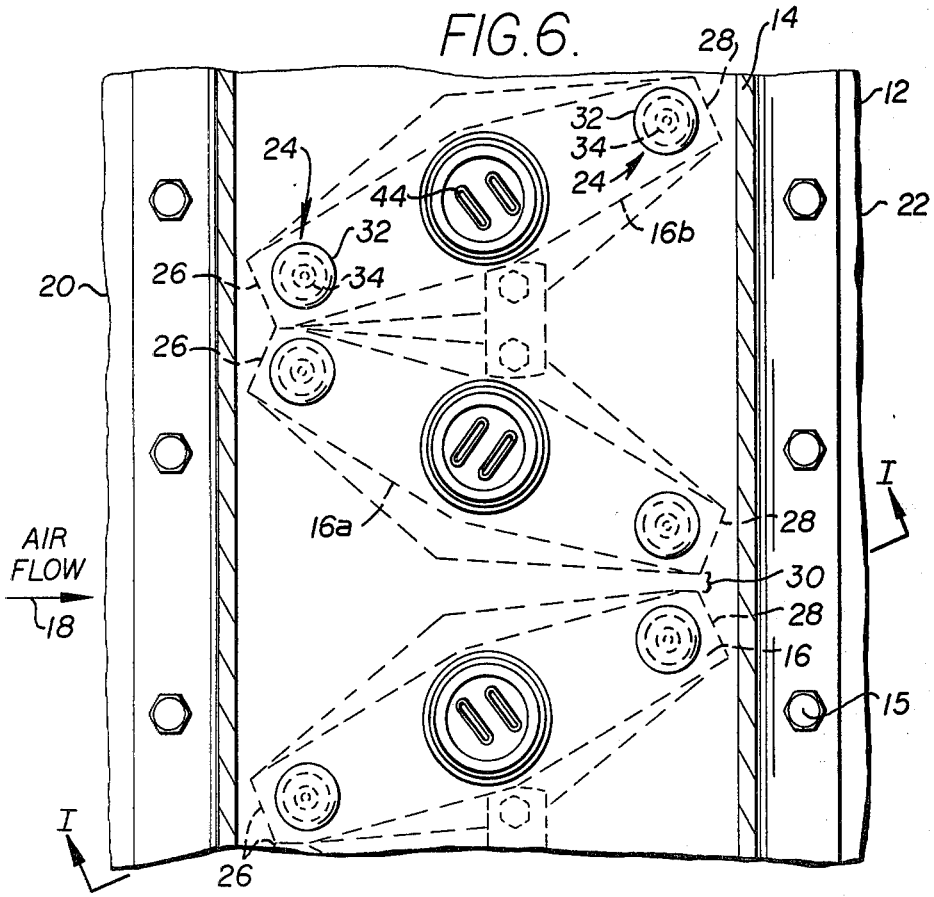

HEAT EXCHANGER CORE MOUNTING APPARATUS

This is a continuation of Ser. No. 099,143 filed Sept. 27, 1979, now abandoned.

DESCRIPTION

Technical Field

This invention relates generally to heat exchange and more particularly to positioners for assembly and retention of heat exchanger apparatus.

Background Art

Heat exchangers and radiators, and particularly to type of radiators used to cool internal combustion engines, either on a moving vehicle or on a fixed stationary frame, have usually been constructed as single integral units. In addition, such heat exchangers and radiators have been constructed by mounting a plurality of cooling cores between a pair of spaced inlet and outlet tanks or by connecting the cooling cores together by hoses. These cooling cores include tubes having fins radiating orthogonally therefrom and provide a means for conducting a fluid coolant from the circulating system of the engine to flow from the inlet tank, through the tubes, and into the outlet tank. Air flow, often created by a fan or movement of the vehicle, passes through the radiator to absorb heat from the radiating fins thereby reducing the temperature of the fluid coolant flowing through the tubes.

The heat absorbing air flow often carries debris which clogs and damages the cores. Various attempts have been made to avoid such clogging and damage including arranging multiple core modules angularly in a core mounting frame with respect to air flow in slotted "V" shaped pairs so that the debris is deflected from one of the core faces and directed through the slots. These cores are rotated after a period of use to expose an unabraded core face to the debris laden air flow.

One limitation is that it is costly and time consuming to locate the cores at the proper angular relationship in the first instance and then to locate them again when the cores are rotated. Thus there is a need for a suitable locating means which provides both initial location and rotated location. Previously, the core modules and the inlet/outlet tanks were connected by two fluid coolant carrying tubes at each end of the module. Connection of the tubes provided the desired angular relationship of the module to the air flow. However, these multiple tube connections increased the possibility of leakage of the coolant.

Recognizing that vehicle frames vibrate and distort during operation, the radiator cores have in the past been resiliently mounted in some manner to prevent rupture and leakage of the radiator cores which might otherwise occur if the cores were rigidly attached to the frame or to the manifold. A resilient mounting seal has been provided to limit vibration and seal against leakage. However, another limitation would be to provide a suitable resilient mounting seal which could accommodate the suitable locating means and provide a beneficial seal between the core and the multiple tube connections.

The foregoing illustrates limitations of the known prior art. Thus, it is apparent that it would be advantageous to provide an alternative to the prior art. Accordingly, the present invention is directed to overcoming one or more of the limitations as set forth above.

DISCLOSURE OF INVENTION

In one aspect of the present invention, this is accomplished by providing a heat exchanger core mounting apparatus including means for locating the heat exchanger core in predetermined registration with a frame member. The invention also includes means for sealingly and resiliently mounting the core in the frame which accommodates the locating means.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BRIEF DESCRIPTION OF THE DRAWINGS

In the drawings:

FIG. 3 is a top planar view illustrating a resilient member of this invention;

FIG. 4 is a side elevational view in partial cross-section illustrating the resilient member as viewed along lines IV—IV of FIG. 3;

FIG. 5 is a side elevational view illustrating the locating means as viewed along the lines V—V of FIG. 2; and FIG. 6 is a top view illustrating the angular relationship of adjacent core modules of this invention as viewed along the line VI—VI of FIG. 1.

BEST MODE FOR CARRYING OUT THE INVENTION

Figure 1:
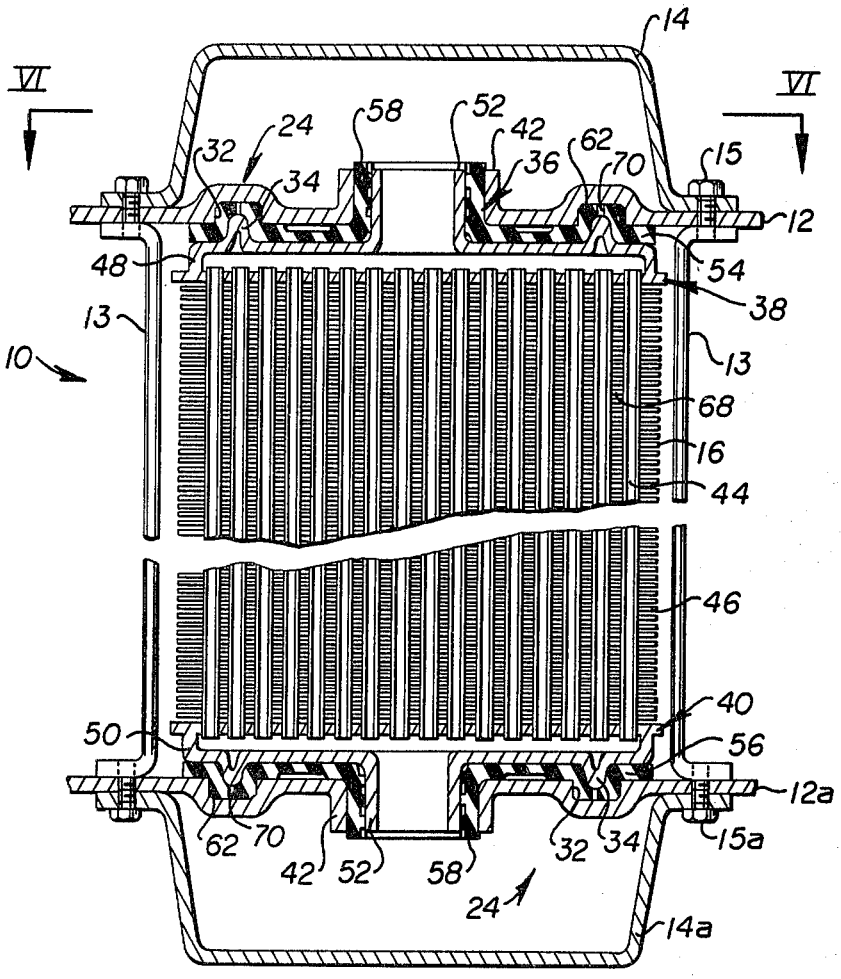
FIG. 1 is a frontal cross-sectional view illustrating an aspect of the present invention as applied to one of a plurality of radiator core modules as viewed along line I—I of FIG. 6.

A heat exchanger core mounting apparatus is designated 10, FIG. 1, and comprises a core supporting frame which includes a pair of spaced apart inlet and outlet header plates 12,12*a*. A main inlet tank 14 is secured to adjacent inlet plate 12 by bolts 15 and a main outlet tank 14*a* is secured to adjacent outlet plate 12*a* by bolts 15*a*. A plurality of core modules, including not limited to 16,16*a*,16*b*, are mounted between plates 12,12*a* and are located in angular relationship with respect to an air flow as indicated by an arrow designated 18, see also FIG. 6. Thus, air flow passes across an upstream side 20 of plates 12,12*a*, through core modules 16,16*a*,16*b* and across a downstream side 22 of plates 12,12*a*.

Means 24 are provided for locating core modules 16,16*a*,16*b* in predetermined registration with plates 12,12*a*. By predetermined registration is meant that core modules are located generally in "V" shaped pairs (FIG. 6) so that one edge 26 of each vore 16,16*a*, 16*b* is adjacent upstream side 20 of plates 12,12*a* and another edge 28 of each core 16 is adjacent downstream side 22. The upstream edges 26 of adjacent cores are in close enough proximity to resist flow therebetween. However, the downstream edges of adjacent cores are in close proximity to permit air flow therebetween in such a manner that a slot 30 is formed of a sufficient size to permit the passage of debris therethrough. The means 24 for locating preferably includes first and second locating members such as detents 32 formed in plates 12,12*a* and corresponding protuberances 34 formed on each core 16.

Means 36 are provided for sealingly and resiliently mounting each core 16,16*a*,16*b* with plates 12,12*a*. One of such means 36 is between an inlet end 38 of core 16 and inlet plate 12 and another of such means 36 is between an outlet end 40 of core 16 and outlet plate 12*a* in a manner so as to accommodate locating means 24.

Plates 12,12*a*, FIGS. 1 and 6 are generally well known and, in accordance with this invention, plates 12,12*a* include aperture 42 and also include the plurality of first locating members or detents 32 adjacent upstream side 20 and adjacent downstream side 22. A plurality of connector bars 13, which do not inhibit air flow, may be used to interconnect plates 12,12*a*.

Figure 2:
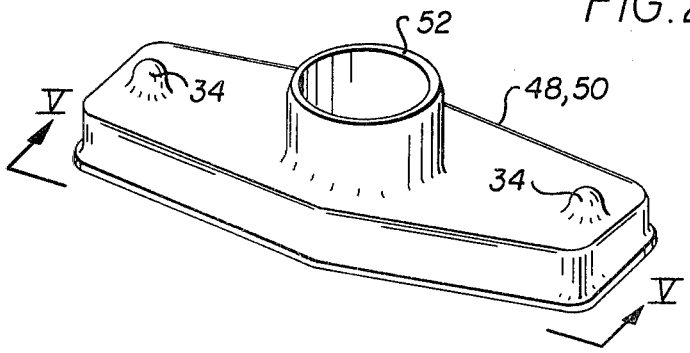
FIG. 2 is an isometric view illustrating a portion of a core module having a pair of locating means of this invention.

Cores 16,16*a*,16*b* are also generally known and, in accordance with this invention, include a plurality of tubes 44 having a plurality of very closely spaced cooling fins 46 radiating orthogonally therefrom. A core inlet tank 48, see also FIGS. 2 and 5, is at inlet end 38 of core 16 and a core outlet tank 50 is at outlet end 40 of core 16. Tanks 48,50 each include an aperture or spout 52 provided for extending into aperture 42 of plates 12,12*a* and also include at least one, and preferably a pair of, second locating members such as protuberances 34 spaced equidistantly from spout 52. Spouts 52 of each core 16,16*a*,16*b* lie on a common axis which, in the form illustrated, is the vertical geometric centerline or longitudinal axis of the core. In this manner each core 16,16*a*,16*b* is pivotally mounted between plates 12,12*a* by virtue of spouts 52 being a pivotal axis. Protuberances 34 are of a construction sufficient for engagement with detents 32. As best illustrated in FIGS. 1 and 6, a pair of protuberances 34 engage a pair of detents 32, one of the protuberances 34 and engaged detents 32 being adjacent upstream side 20 and another of the protuberances 34 and engaged detents 32 being adjacent downstream side 22 for securing any of the cores 16,16*a*,16*b*, or others, in the desired predetermined registration with plates 12,12*a*. More specifically, detents 32 are located in a predetermined registration so that when engaged by a given pair of protuberances 34 on a given core 16,16*a*,16*b*, etc., edge 26 of core 16*a*, for example, is in flow resisting proximity with adjacent core 16*b* at upstream side 20 and edge 28 of core 16*a* is in flow permitting proximity with adjacent core 16 at downstream side 22 forming slot 30. Protuberances 34 can engage either the upstream or downstream detents 32 when core 16 is rotated 180 degrees so that either edge 26,28 is adjacent upstream side 20 or downstream side 22 for exposing either one of the similar opposed faces 68 (only one of which is shown in FIG. 1) of core 16.

Means 36, see also FIGS. 3 and 4, comprises a generally known inlet resilient mounting member 54 and an outlet resilient mounting member 56, each member including a single lip 58 for sealing between aperture 42 and spout 52 and peripheral resilient mounting strip 60. In accordance with this invention, each member includes resilient locating detent pads 62 formed to accommodate protuberances 34 on one side 64 and to accommodate detents 32 on another side 66. As illustrated in FIG. 1, inlet resilient member 54 is between core inlet tank 48 and inlet plate 12, whereas outlet resilient member 56 is between core outlet tank 50 and outlet plate 12*a*. Apertures 70 are formed through pads 62 to limit air entrapment between detents 32 and protuberances 34.

INDUSTRIAL APPLICABILITY

With the parts assembled as set forth above, hot fluid is introduced into main inlet tank 14 and then flows downwardly through tubes 44 of core 16 and into the main outlet tank 14*a*. The fluid is cooled in the core 16 in the usual manner. As the fins 46 on faces 68 of the core 16 which are receiving air flow are erroded or abraded due to sand particles and the like in the air flow it may become necessary to rotate the core 16. One can first remove main tank 14, loosen or remove bolts 15 and partially separate the core 16 from the input plate 12 and the output plate 12*a* and rotates core 16, in place, 180°. The entire assembly is then positioned back in place. Generally, the resilient means 36 will not be rotated but will be left affixed to the core 16.

The present heat exchanger structure is useful for cooling internal combustion engines such as are used in vehicles and in stationary installations. The possibility of leakage is minimized by providing only a single fluid communication between each core 16, its inlet plate 12 and its outlet plate 12*a*. The entire core 16 can be rotated relative to the plates 12 and 12*a* without disassembly of the apparatus 10.

The foregoing has described a heat exchanger core mounting apparatus which is sealingly and resiliently mounted in a frame and locates the core in predetermined registration with the frame.

It is anticipated that aspects of the present invention, other than those specifically defined in the appended claims, can be obtained from the foregoing description and the drawings.

I claim:

1. A heat exchanger comprising:

first and second frame members (12,12*a*) each having a bore (42) therein;

a core (16) extending between the frame members (12,12*a*) and having first and second opposed end portions (38,40), each end portion having a spout (52) extending outwardly into the bore (42) of the adjacent frame member (12,12*a*);

resilient means (36) for resiliently and sealingly supporting the core (16) between the frame members (12,12*a*), said resilient means including a pair of resilient pads (54,56) each positioned between one of the end portions (38,40) and the adjacent frame member (12,12*a*); and means (24) for locating the core (16) in a predetermined registration with the frame members (12,12*a*), said means (24) including an imperforate protuberance (34) extending outwardly from one of said first end portions (38) and said first frame member (12) and spaced from the spout (52), and an imperforate recess (32) in the other of said first end portion (38) and said first frame member (12) and being in registry with the protuberance (34), said one resilient pad (54) positioned between said first end portion (38) and said first frame member (12) having a portion (62) resiliently accommodating the protuberance (34) and the recess (32).

2. The heat exchanger, as set forth in claim 1, wherein said locating means (24) includes another imperforate protuberance (34) extending outwardly from one of said second end portion (40) and said second frame member (12*a*) and spaced from the spout (52) and another imperforate recess (32) in the other of said second end portion

(40) and said second frame member (12*a*) and being in registry with the other protuberance (34), the other resilient pad (56) having a portion (62) resiliently accommodating the other protuberance (34) and the other recess (32).

3. The heat exchanger, as set forth in claim 2, including a plurality of said cores (16,16*a*,16*b*) extending between the frame members (12,12*a*), a plurality of said resilient means (36) for resiliently and sealingly supporting the cores (16,16*a*,16*b*) between the frame members (12,12*a*) and a plurality of said means (16) for locating the cores in predetermined registration with the frame members (12,12*a*).

4. A heat exchanger comprising:

a pair of frame members (12,12*a*) each having a bore (42) therein;

a core (16) extending between the frame members (12,12*a*) and having opposed end portions (38,40) and a spout (52) extending outwardly from each end portion (38,40) and into the bores (42) of the frame members (12,12*a*);

a pair of first Imperforate locating members (34) on one of the end portions (38,40) and positioned on opposite sides of the spout (52);

a pair of second Imperforate locating members (32) on the one frame member (12,12*a*) adjacent the one end portion (38,40), said second locating members (32) being in registry with the first ionperforate locating members (34) and positioned for locating the core (16) in a predetermined registration with the frame members (12,12*a*); and resilient means (36) for resiliently and sealingly supporting the core (16) between the frame members (12,12*a*), said resilient means including a pair of resilient pads (54,56) each positioned between one of the end portions (38,40) and the adjacent frame member (12,12*a*), one of the resilient pads having a pair of portions (62) resiliently accommodating the first and second Imperforate locating members (34,32)

5. The heat exchanger, as set forth in claim 4 wherein said first Imperforate locating members (34) are positioned equidistantly from the spout (52).

6. The heat exchanger, as set forth in claim 5, including a second pair of first imperforate locating members (34) on the other of the end portions (38,40) and being positioned on opposite sides of the spout (52) and positioned equidistantly therefrom, a second pair of second imperforate locating members (32) on the other of said frame members (12,12*a*), said second pair of second imperforate locating members (32) being in registry with the second pair of first imperforate locating members (34), and wherein the other of said resilient pads (54,56) has a pair of portions (62) resiliently accomodating the second pairs of the first and second imperforate locating members (34,32).

7. The heat exchanger, as set forth in claim 4 wherein each of said first Imperforate locating members (34) is a protuberance (34) extending outwardly from the one end portion (38,40), and each of said second Imperforate locating members is a detent (32) formed in the adjacent frame member (12,12*a*).

* * * * *